US006347928B1

(12) United States Patent
Renaud

(10) Patent No.: US 6,347,928 B1
(45) Date of Patent: Feb. 19, 2002

(54) CONNECTING MEMBER FOR A PUMP

(75) Inventor: Patrick Renaud, Brossard (CA)

(73) Assignee: Wildfire Equipment Inc., Lachine (CA)

( * ) Notice: Subject to any disclaimer, the term of this patent is extended or adjusted under 35 U.S.C. 154(b) by 0 days.

(21) Appl. No.: 09/706,192

(22) Filed: Nov. 3, 2000

(30) Foreign Application Priority Data

Nov. 3, 1999 (CA) ..... 2288462

(51) Int. Cl.[7] ..... F04B 17/00
(52) U.S. Cl. ..... 417/360; 417/364
(58) Field of Search ..... 417/360, 364

(56) References Cited

U.S. PATENT DOCUMENTS 4,643,652 A * 2/1987 Eberhardt ..... 417/364
4,676,065 A * 6/1987 Eberhart ..... 60/310
4,690,613 A * 9/1987 Eberhardt ..... 415/148
4,793,386 A * 12/1988 Sloan ..... 141/65
5,456,412 A * 10/1995 Agee ..... 239/104

* cited by examiner

*Primary Examiner*—Teresa Walberg
*Assistant Examiner*—Vinod D. Patel

(74) *Attorney, Agent, or Firm*—Darby & Darby

(57) ABSTRACT

A connector for connecting a pump to a portable engine. The engine being connected to the pump through a shaft extending along a central axis and adapted to be mechanically connected to the engine. The connector includes a first and second coupling members designed to be attached together. The first coupling member including a first contact surface having a plane perpendicular to the central axis, a first sleeve projecting outwardly from the first contact surface. The first sleeve having a radius larger than the radius of the shaft. The first coupling member further including at least one flange projecting inwardly from the sleeve. The flange defines at least one opening. The second coupling member is coaxial to the central axis and is adapted to be installed on the other one of the pump and the engine. The second coupling member comprises a second contact surface complementary to the first contact surface, a second sleeve projecting outwardly from the second contact surface. The second sleeve having a radius larger than the radius of the shaft. The second coupling member comprises at least one tooth projecting outwardly from the second sleeve. The tooth is designed to fit in the at least one opening of the first sleeve. The connector is designed so that when the first and second sleeves are brought together, the at least one tooth is in registry and is adapted to fit within the at least one opening of the first sleeve so to allow rotational engagement between the first and second coupling members and thereby frictionally engage and connect the first and second coupling members together.

8 Claims, 4 Drawing Sheets

CONNECTING MEMBER FOR A PUMP

FIELD OF THE INVENTION

The present invention broadly relates to the field of pumping apparatuses. More precisely, the invention is concerned with a connector for connecting a portable pump to an engine.

BACKGROUND OF THE INVENTION

Known in the art is Canadian patent no. 563.438, which concerns an internal combustion engine and a pump which are so linked together that they can be set up quickly at the point of use. The engine has a housing which includes a collar extending axially outwardly about its drive shaft. The pump has a housing including a collar extending axially outwardly about its impeller drive shaft. The respective collars have abutting portions adapted to register with each other, with an outwardly extending flange. Clamping means are provided for clamping the respective collars together, so that the pump body is removably connected to the engine. The clamping means comprise a split-ring adapted to encircle the mating flanges. One end of each split ring is connected to the adjacent end of the other split ring by an adjustable screw connection, so that the circumference of the entire ring can be adjusted. The other ends of the split rings are connected together by a toggle link controlled by a clamping lever, whereby these ends can be drawn together after the device has been put in place to encircle the mating flanges of the pump and engine.

Although quite successful, this linkage suffers from a number of drawbacks, such as difficulty in clamping, jamming of the mechanism, fatigue, and length of time required to unclamp the collar, change one part or the other of the pump, and then reclamp both components.

SUMMARY OF THE INVENTION

It is an object of the present invention to provide a connector for connecting a pump to an engine that is easy to manipulate and that may allow the pump to be readily detachable from the engine. It is another object of the present invention to provide a connector that will not jam when connecting a pump to an engine.

It is a further object of the present invention to provide a connector that is simple in structure thereby rendering it simple to manufacture. In accordance with the invention, these objects are achieved with a connector for connecting a pump to a detachable engine, the engine being connected to the pump through a shaft extending along a central axis and adapted to be mechanically connected to the engine and the pump, the connector comprising:

a first coupling member adapted to be installed on any one of the pump and the engine, the first coupling member extending along an axis that is coaxial to the central axis, the first coupling member comprising a first contact surface having a plane perpendicular to the central axis;

a first sleeve projecting outwardly from the first contact surface and having a radius larger than the radius of the shaft, and at least one flange projecting inwardly from the sleeve, the flange defining at least one opening, the at least one flange defining an inner radius smaller than the radius of the first sleeve but larger than the radius of the shaft, a second coupling member coaxial to the central axis and adapted to be installed on the other one of the pump and the engine, the second coupling member comprising:

a second contact surface complementary to the first contact surface, a second sleeve projecting outwardly from the second contact surface, and having a radius larger than the radius of the shaft but smaller than the inner radius of the first sleeve, and at least one tooth projecting outwardly from the second sleeve, the at least one tooth designed to fit in the at least one opening of the first sleeve, wherein, when the first and second sleeves are brought together, the at least one tooth is in registry and is adapted to fit within the at least one opening of the first sleeve so to allow rotational engagement between the first and second coupling members and thereby frictionally engage and connect said first and second coupling members together.

An advantage provided by such connector is that it is designed to quickly set up the pump and the engine as well as to quickly release the pump from the engine when needed so. This connector also advantageously allows a user to disconnect the pump from the engine without requiring the use of any tools.

DETAILED DESCRIPTION OF THE INVENTION

Figure 1:
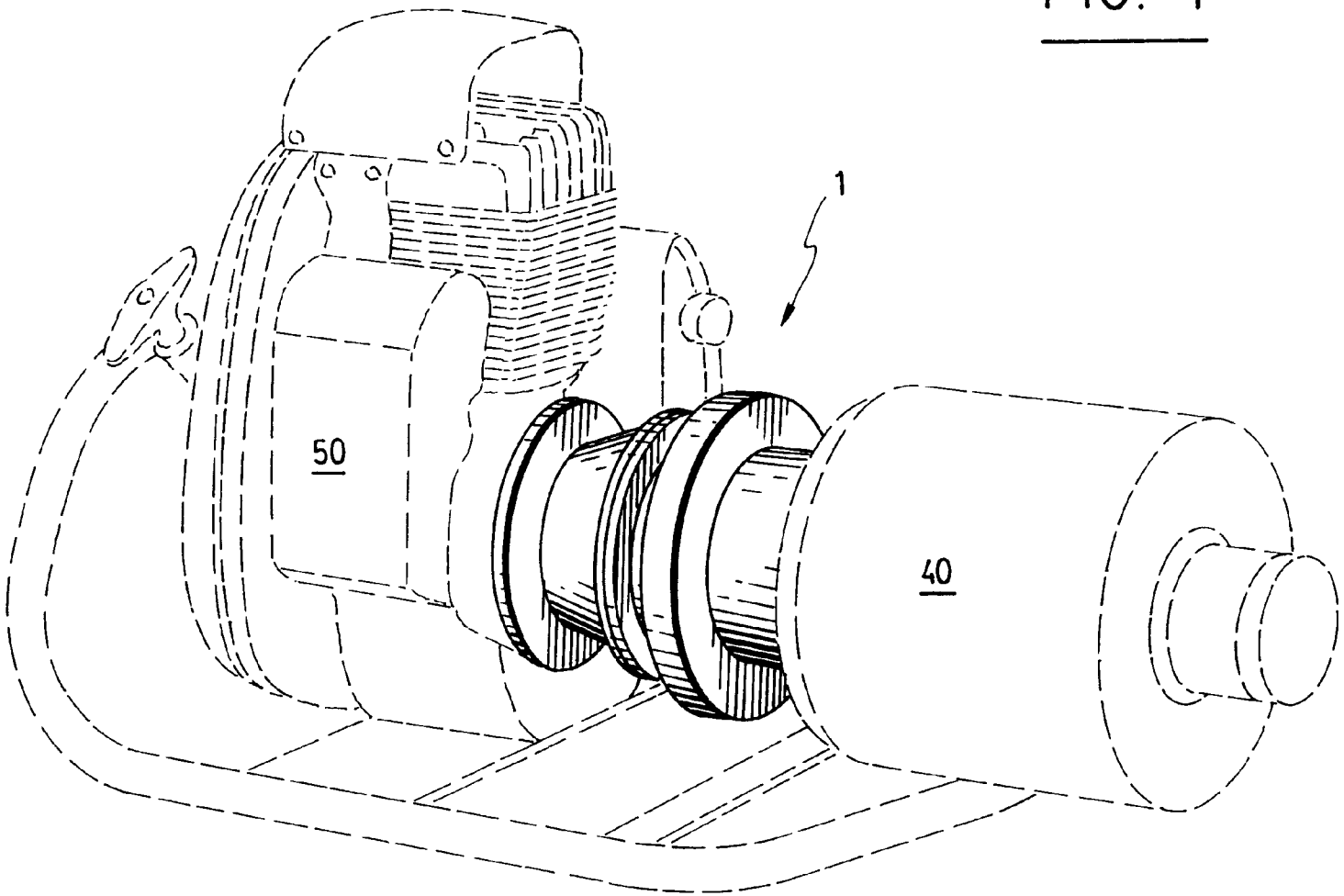
FIG. 1 is a perspective view of the connector according to a preferred embodiment of the present invention. The connector in a closed position and mounted on a pump and an engine which are seen in doted lines.

As shown in FIG. 1, the connector 1 according the invention is adapted to be installed on a portable pumping apparatus. An engine 50 is connected to the pump 40 through a shaft 3 which extends along a central axis. The shaft 3 is adapted to mechanically connect the pump 40 to the engine 50. The connector 1 comprises a first coupling member 21 and a second coupling member 31. In the illustrated embodiment, the first coupling member 21 is adapted to be installed on one end of the pump 40 and the second coupling member 31 is installed on the end of the engine 50 that is facing the pump 40.

Figure 2:
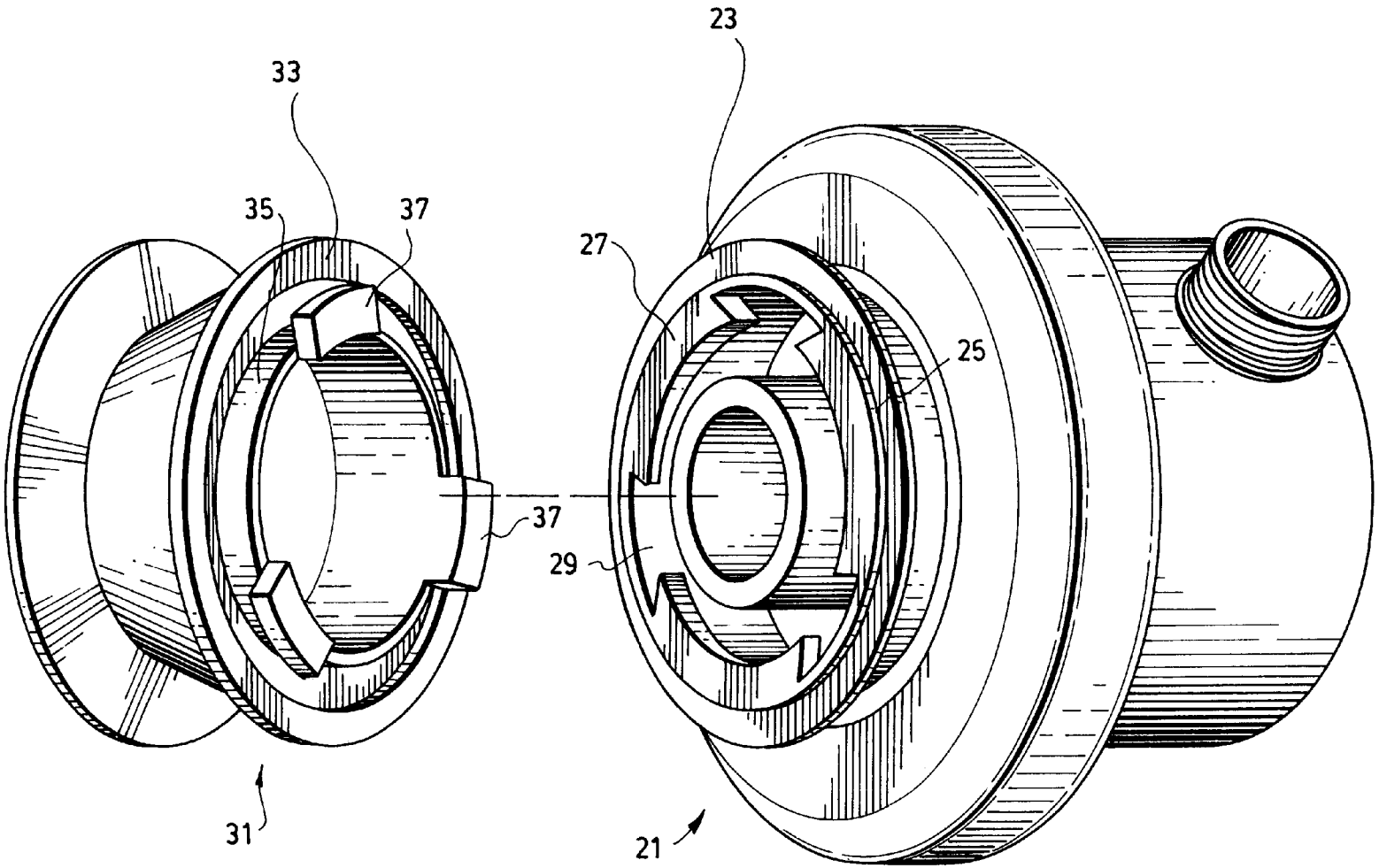
FIG. 2 is a perspective view of the connector of FIG. 1, in an open position.

Referring now to FIG. 2, the first coupling member 21 comprises a first contact surface 23. The first contact surface is defined by an edge which is perpendicular to the central axis of the connector. The edge is designed to receive a corresponding end of the second coupling member 33. The first coupling member 21 also comprises a first sleeve 25 projecting outwardly from the first contact surface 23. The first sleeve 25 has a radius larger than the radius of the shaft. The first coupling member 21 further comprises at least one flange 27 projecting inwardly from the sleeve 25. The flange 27 defines at least one opening 29. The flange 27 also defines an inner radius that is smaller than the radius of the first sleeve 25 but larger than that of the shaft 3.

The second coupling member 31 is coaxial to the central axis and is adapted to be installed on the engine 50. As mentioned hereinabove, the second coupling member 31 is installed on one of the ends of the engine 50 that is opposite to the end of the pump 40 where the first coupling member 21 is installed. The second coupling member 31 comprises a second contact surface 33 which is complementary to the first contact surface 23. It also comprises a second sleeve 35 which projects outwardly from the second contact surface 33. The second sleeve 35 has a radius larger than the radius of the shaft 3 but smaller than the inner radius of the first sleeve 25. The second coupling member 31 further comprises at least one tooth 37 projecting outwardly from the second sleeve 35. The tooth 37 is designed to fit in the at least one opening 29 of the first sleeve 25.

The connector 1 is designed so that when the first and second sleeves 25,35 are brought together, the at least one tooth 37, on the second sleeve 35, is in registry and is adapted to fit within the at least one opening 29 of the first sleeve 25 so to allow rotational engagement between the first and second coupling members 21,31 and thereby frictionally engage and connect the first and second coupling members 21,31 together.

As further seen in FIG. 2, the connector 1 comprises three flanges 27 projecting inwardly from the wall of the first coupling member 21, thereby producing three openings. Accordingly, the second coupling member 31 comprises three corresponding teeth 37 projecting outwardly therefrom. The teeth 37 are set so that in the open position, when the first and second coupling members 21,31 are brought together, the teeth 37 are in registry with the three openings 29 of the first coupling member 21. This allows the second coupling member 31 to be inserted in the first coupling member 21 and upon rotation of the latter relative to the former, they are tightly fastened together as shown in FIG. 3.

Figure 4:
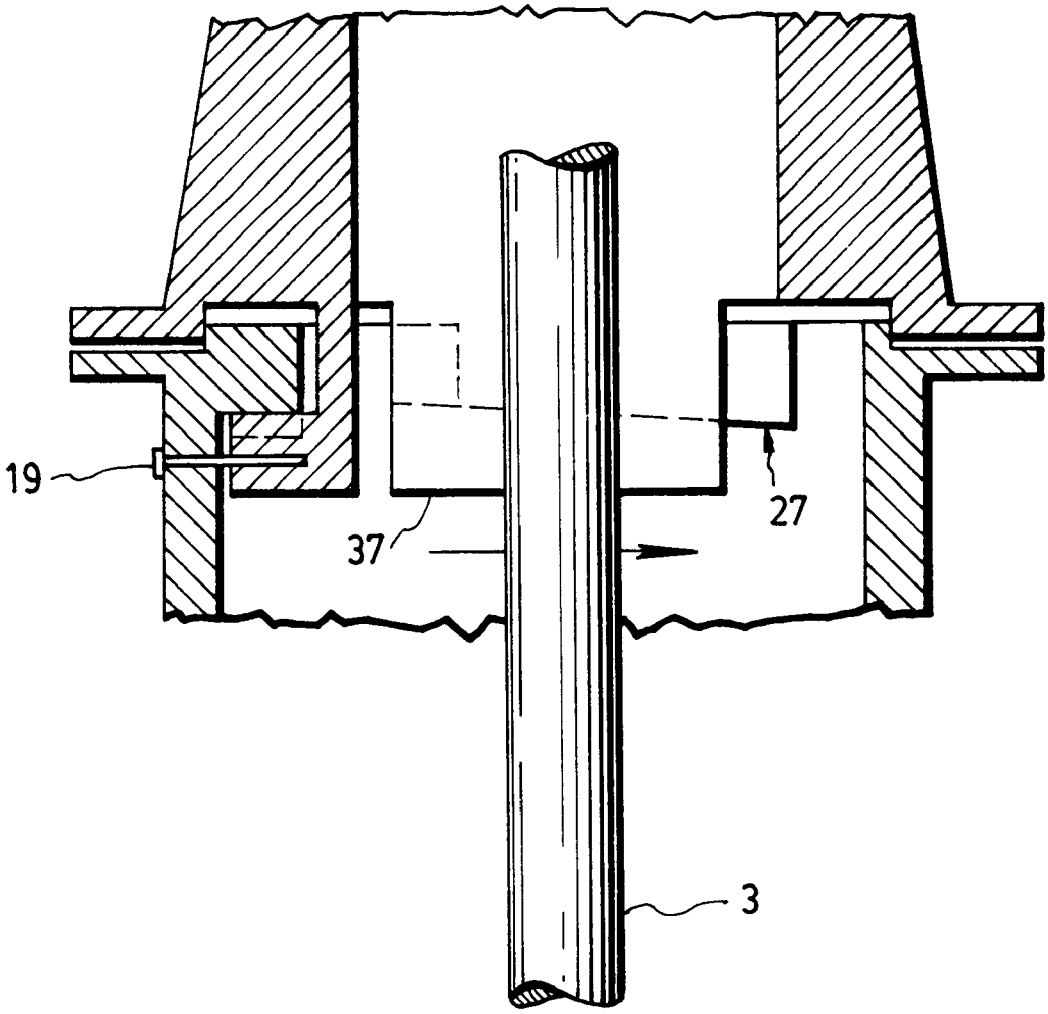
FIG. 4 is a partial cross sectional view of the connector of FIG. 3.

As best seen in FIG. 4, each flange 27 comprises an inclined bottom surface designed to form a cam. The flange 27 is adapted to receive a corresponding tooth 37 so that upon rotation of the first coupling member 21 relative to the second coupling member 31, both coupling members are secured together.

The connector 1 according to the present invention may also comprise a shock absorber (not shown) to prevent loosening between the first and second coupling members 21,31 caused by vibration during operation of the engine 50. The shock absorber is secured between the first and second contact surfaces 23,33 of the first and second coupling members 21,31 when they are engaged in the closed position. Preferably, the shock absorber is an O-ring made of nitrile.

Figure 3:
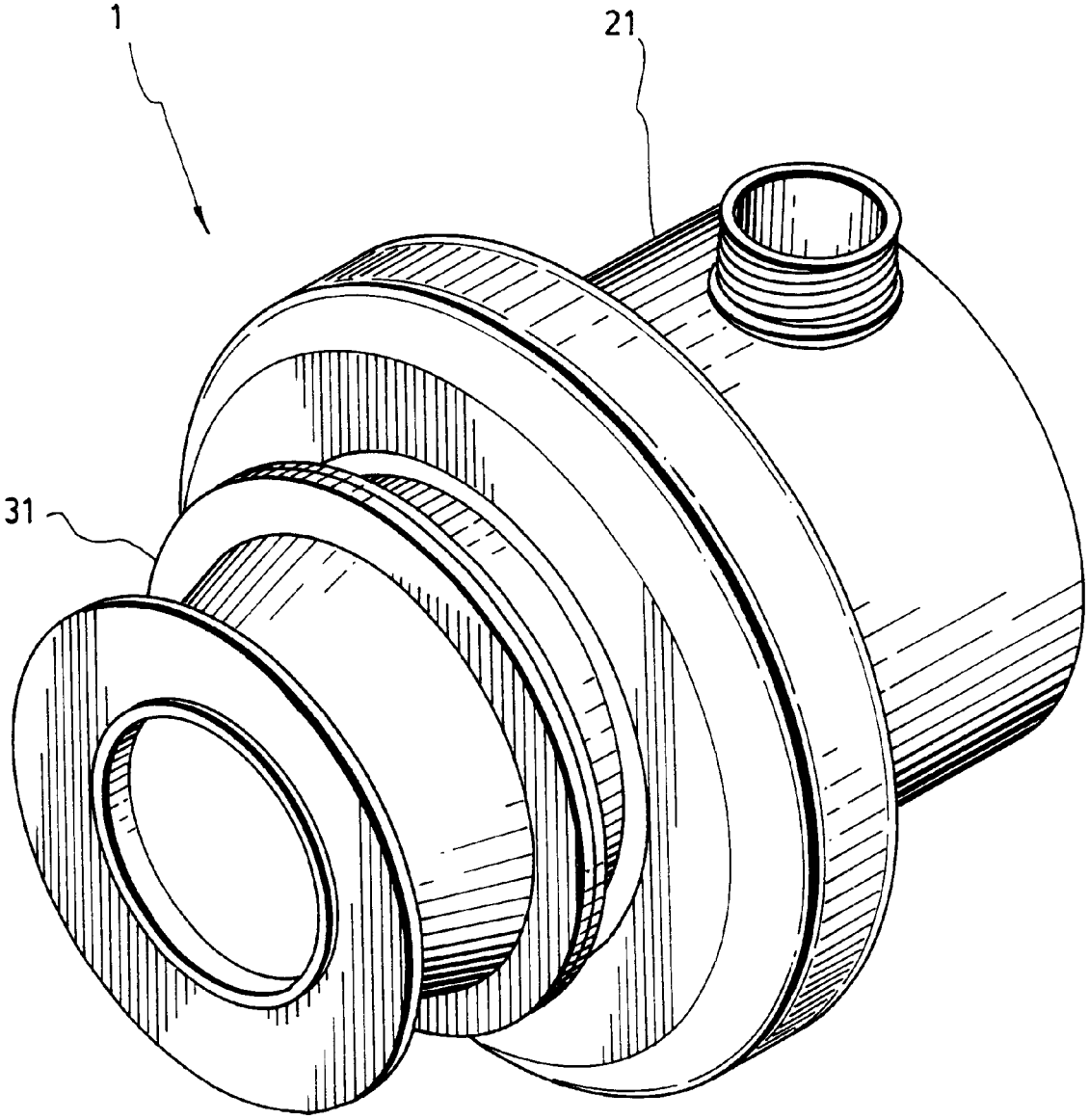
FIG. 3 is a perspective view of the connector of FIG. 2 in a closed position.

As seen in FIGS. 2 to 4, the connector 1 may further comprise a lock for locking the first and second coupling members 21,31 together. In the illustrated embodiment, the lock may comprise a pin 61 that is designed to be inserted in a set of hole 63 provided on the first and second contact surfaces 23,33. The holes 63 located on the first and second contact surface are positioned so that when the first and second coupling members 21,31 are engaged together in the closed position, they are aligned.

Although the present invention has been explained herein above by way of preferred embodiment thereof, it should be pointed out that any modification to this preferred embodiment within the scope of the present description is not deemed to alter or change the nature and scope of the invention.

What is claimed is:

1. A connector for connecting a pump to a detachable engine, the engine being connected to the pump through a shaft extending along a central axis and adapted to be mechanically connected to the engine and the pump, the connector comprising:

a first coupling member adapted to be installed on any one of the pump and the engine, the first coupling member extending along an axis that is coaxial to the central axis, the first coupling member comprising a first contact surface having a plane perpendicular to the central axis;

a first sleeve projecting outwardly from the first contact surface and having a radius larger than the radius of the shaft, and at least one flange projecting inwardly from the sleeve, the flange defining at least one opening, the at least one flange defining an inner radius smaller than the radius of the first sleeve but larger than the radius of the shaft, a second coupling member coaxial to the central axis and adapted to be installed on the other one of the pump and the engine, the second coupling member comprising:

a second contact surface complementary to the first contact surface, a second sleeve projecting outwardly from the second contact surface, and having a radius larger than the radius of the shaft but smaller than the inner radius of the first sleeve, and at least one tooth projecting outwardly from the second sleeve, the at least one tooth designed to fit in the at least one opening of the first sleeve, wherein, when the first and second sleeves are brought together, the at least one tooth is in registry and is adapted to fit within the at least one opening of the first sleeve so to allow rotational engagement between the first and second coupling members and thereby frictionally engage and connect said first and second coupling members together.

2. A connector according to claim 1, wherein the first coupling member comprises three flanges projecting inwardly from the first sleeve, the three flanges defining three openings.

3. A connector according to claim 2, wherein the second coupling member comprises three teeth projecting outwardly from the second sleeve, the three teeth being spaced apart so to be in registry with the three openings on the second coupling member when the first and second coupling members are brought together.

4. A connector according to claim 3, wherein each flange comprises an inclined bottom surface designed to form a cam and adapted to receive a corresponding bottom surface of the corresponding tooth so that upon rotation of the first coupling member relative to the second coupling member, said first and second coupling members are tightly fastened.

5. A connector according to claim 4, further comprising a shock absorber for preventing loosening of the first and second coupling members caused by vibration during operation of the engine, the shock absorber being secured between the first and second contact surface when the first and second coupling members are fastened together.

6. A connector according to claim 5, wherein the shock absorber is an O-ring made of a suitable material.

7. A connector according to claim 1, further comprising a lock for locking the first and second coupling members together.

8. A connector according to claim 7, wherein the lock comprises a pin designed to be inserted in two holes located on the first and second coupling members, the holes being placed so to be aligned when the first and second coupling members are engaged.

* * * * *